US010107092B2

(12) United States Patent
Jaaskelainen et al.

(10) Patent No.: US 10,107,092 B2
(45) Date of Patent: Oct. 23, 2018

(54) FLOW SENSING FIBER OPTIC CABLE AND SYSTEM

(71) Applicant: Halliburton Energy Services, Inc., Houston, TX (US)

(72) Inventors: Mikko Jaaskelainen, Katy, TX (US); Ian Bradford Mitchell, Houston, TX (US); Brian V. Park, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/099,571

(22) Filed: Apr. 14, 2016

(65) Prior Publication Data

US 2016/0230542 A1 Aug. 11, 2016

Related U.S. Application Data

(62) Division of application No. 13/797,922, filed on Mar. 12, 2013.

(51) Int. Cl.

| | |
|---|---|
| ***E21B 47/00*** | (2012.01) |
| ***E21B 47/10*** | (2012.01) |
| ***E21B 47/12*** | (2012.01) |

(52) U.S. Cl.

CPC ..... *E21B 47/101* (2013.01); *E21B 47/123* (2013.01)

(58) Field of Classification Search

CPC .. E21B 47/101; E21B 47/123; G01M 11/083; G01L 1/246; G01D 5/268; G01F 1/30

See application file for complete search history.

(56) References Cited

U.S. PATENT DOCUMENTS

| | | | | |
|---|---|---|---|---|
| 5,777,278 | A * | 7/1998 | Bednarczyk | E21B 47/101 166/264 |
| 6,933,491 | B2 * | 8/2005 | Maida, Jr. | E21B 47/123 250/227.14 |
| 7,355,163 | B2 * | 4/2008 | Watley | E21B 47/102 250/227.14 |
| 7,827,859 | B2 * | 11/2010 | Pipchuk | E21B 33/124 73/152.18 |
| 9,465,137 | B2 * | 10/2016 | Lagace | G01V 8/00 |
| 9,551,809 | B2 * | 1/2017 | Barry | G01V 8/16 |
| 9,605,534 | B2 * | 3/2017 | Chen | E21B 47/1005 |
| 2002/0174728 | A1 | 11/2002 | Beresford et al. | |
| 2002/0196993 | A1 | 12/2002 | Schroeder | |
| 2005/0224229 | A1 * | 10/2005 | Blacklaw | E21B 47/0006 166/253.1 |
| 2010/0018323 | A1 | 1/2010 | Cheng et al. | |
| 2010/0207019 | A1 * | 8/2010 | Hartog | E21B 47/101 250/269.1 |

(Continued)

OTHER PUBLICATIONS

"Canadian Application Serial No. 2,897,829, Second Office Action dated Jul. 11, 2017" , 4 pages.

(Continued)

*Primary Examiner* — Natalie Huls
(74) *Attorney, Agent, or Firm* — Gilliam IP PLLC

(57) ABSTRACT

A system and method for monitoring oil flow rates at multiple points in production wells using a flow sensing fiber optic cable. An illustrative system embodiment includes: a fiber optic sensing system housed within a tube suitable for a downhole environment; and a flow to signal conversion device attached to the tube and deployed in the oil flow.

13 Claims, 10 Drawing Sheets

(56) References Cited

U.S. PATENT DOCUMENTS

| | | | | |
|---|---|---|---|---|
| 2010/0219334 | A1* | 9/2010 | Legrand | E21B 47/10 250/256 |
| 2011/0088462 | A1 | 4/2011 | Samson | |
| 2011/0100112 | A1* | 5/2011 | Du | E21B 47/10 73/152.32 |
| 2011/0139447 | A1* | 6/2011 | Ramos | E21B 47/09 166/254.2 |
| 2012/0046866 | A1 | 2/2012 | Meyer | |
| 2012/0103082 | A1 | 5/2012 | Ross | |
| 2012/0143524 | A1* | 6/2012 | Chen | G01L 25/00 702/42 |
| 2012/0206718 | A1* | 8/2012 | Jaaskelainen | G01D 5/35348 356/73.1 |
| 2014/0175271 | A1* | 6/2014 | Samson | E21B 47/123 250/264 |
| 2014/0229121 | A1 | 8/2014 | Greco et al. | |
| 2016/0041015 | A1* | 2/2016 | Sheverev | G01F 1/74 73/777 |
| 2017/0123103 | A1* | 5/2017 | Tsakalakos | E21B 47/1005 |

OTHER PUBLICATIONS

CA Application Serial No. 2,897,829, Third Examiner's Letter, dated Apr. 18, 2018, 4 pages.

* cited by examiner

FLOW SENSING FIBER OPTIC CABLE AND SYSTEM

CROSS-REFERENCE TO RELATED APPLICATIONS

This application is a divisional of U.S. application Ser. No. 13/797,922, filed Mar. 12, 2013.

BACKGROUND

Oil wells flow naturally for a short period of time before reservoir engineers need to employ artificial lift techniques to boost production. Their challenge is to determine the rate and content of fluid production from each zone so that production can be optimized. Such information has been relatively straightforward to acquire due to a large Joule-Thompson cooling effect as gas expands, and Distributed Temperature Sensing (DTS) systems have been deployed in many gas wells. Thermal differences during production in oil wells are smaller given the lower flow rates and smaller Joule-Thompson effect.

There is a growing need for the ability to monitor low oil flow rates at multiple points in oil production wells.

DETAILED DESCRIPTION

In the following detailed description, reference is made that illustrate embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques.

Therefore, the description that follows is not to be taken as limiting on the scope of the appended claims.

In the following embodiments a combination of a fiber optic sensing system, and one or multiple flow to signal conversion devices are placed along a fiber optic sensing cable. These fiber optic sensing cables normally include an optical fiber housed in a rugged tube suitable for use in a down-hole environment. The fiber optic sensing cable and the flow to signal conversion devices are lowered in the well to suitably cover the perforated production intervals that are to be monitored. The fiber optic sensing cable and flow to signal conversion devices can also be attached to tubing, stringers or other devices that can be lowered in a production well. The fiber optic sensing cable can be placed below artificial lift devices like e.g. Electrical Submersible Pumps (ESP), rod pumps, hydraulic pumps, or gas lift injectors using any of the methods described above. Some system embodiments may further benefit from having flow sensors in the annular space or production path above the artificial lift device.

Figure 1:
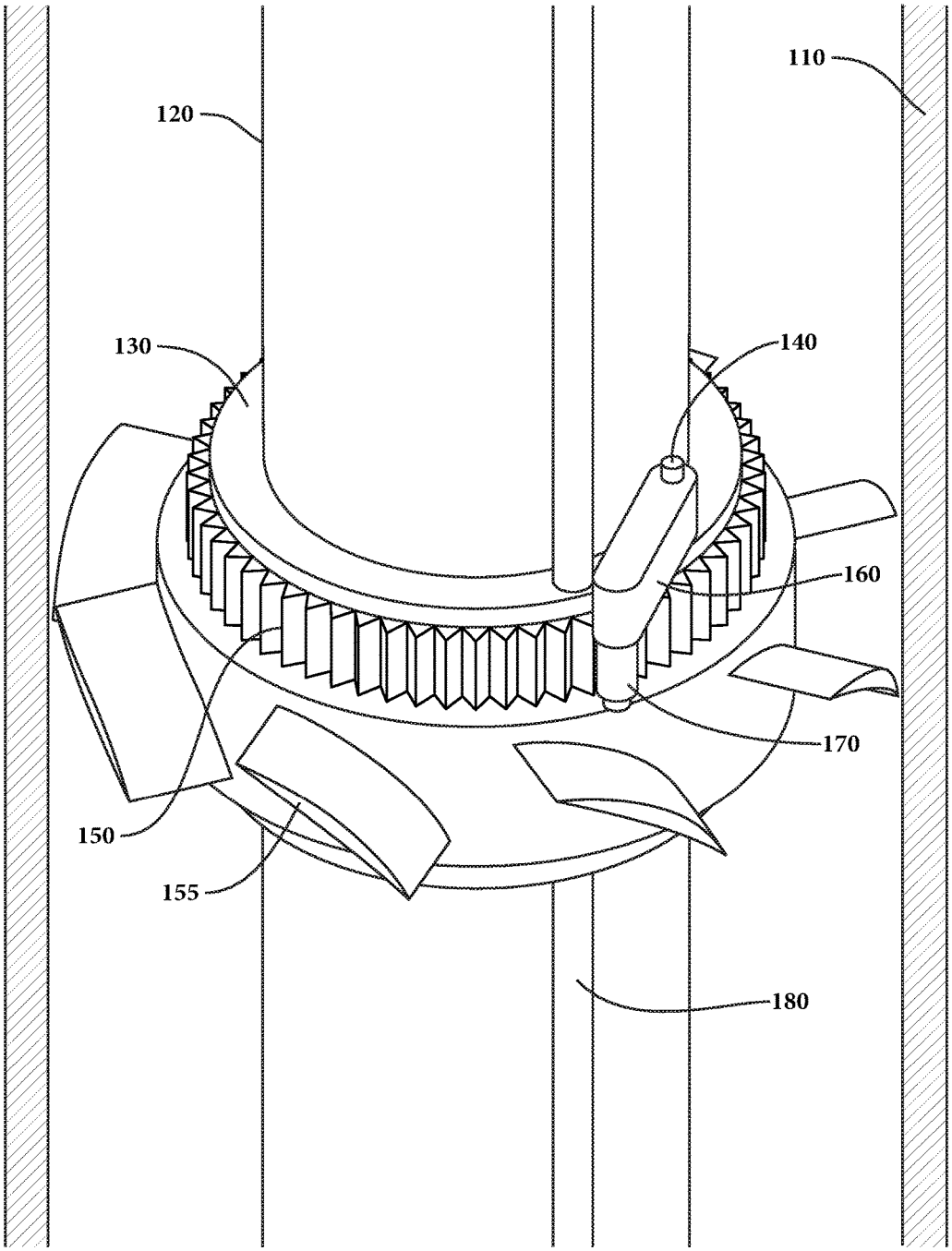
FIG. 1 illustrates a fiber optic flow measurement system using Distributed Acoustic Sensors within a tube and a low friction spinner with noise generation.

FIG. 1 illustrates a first embodiment in which the fiber optic sensing system is a Distributed Acoustic Sensing (DAS) system. A production string 120, which could be coiled tubing, is deployed inside a well casing 110. The DAS system includes a rugged fiber optic cable 180. The fiber optic cable might be a Fiber in Metal Tube (FIMT). The illustrated flow to signal conversion device is a low friction spinner 155, spinning around along a stationary bearing 130 as the oil flows upward against the spinner's vanes and turns the spinner at a rate indicative of the fluid flow rate. A spring-loaded roller-follower includes a pin 140 mounted to bearing 130 to attach an extended arm 160. The arm 160 has a roller 170 that rolls across the bumps 150 of the spinner to generate a noise frequency proportional to the rotation speed of the spinner. The roller-follower impacts bumps 150 at a rate determined by the rotation speed of the spinner and thus generates noise pulses at a frequency proportional to the rotation speed of the spinner. The resultant acoustic noise generated by the roller-follower combination is then detected by the DAS system's interrogating fiber optic cable 180. This noise frequency can be directly calibrated to the flow rate of the oil. Note that the "spring-loaded roller-follower" can be traded out for nearly any kind of follower that generates an acoustic response to the bumps.

Figure 2:
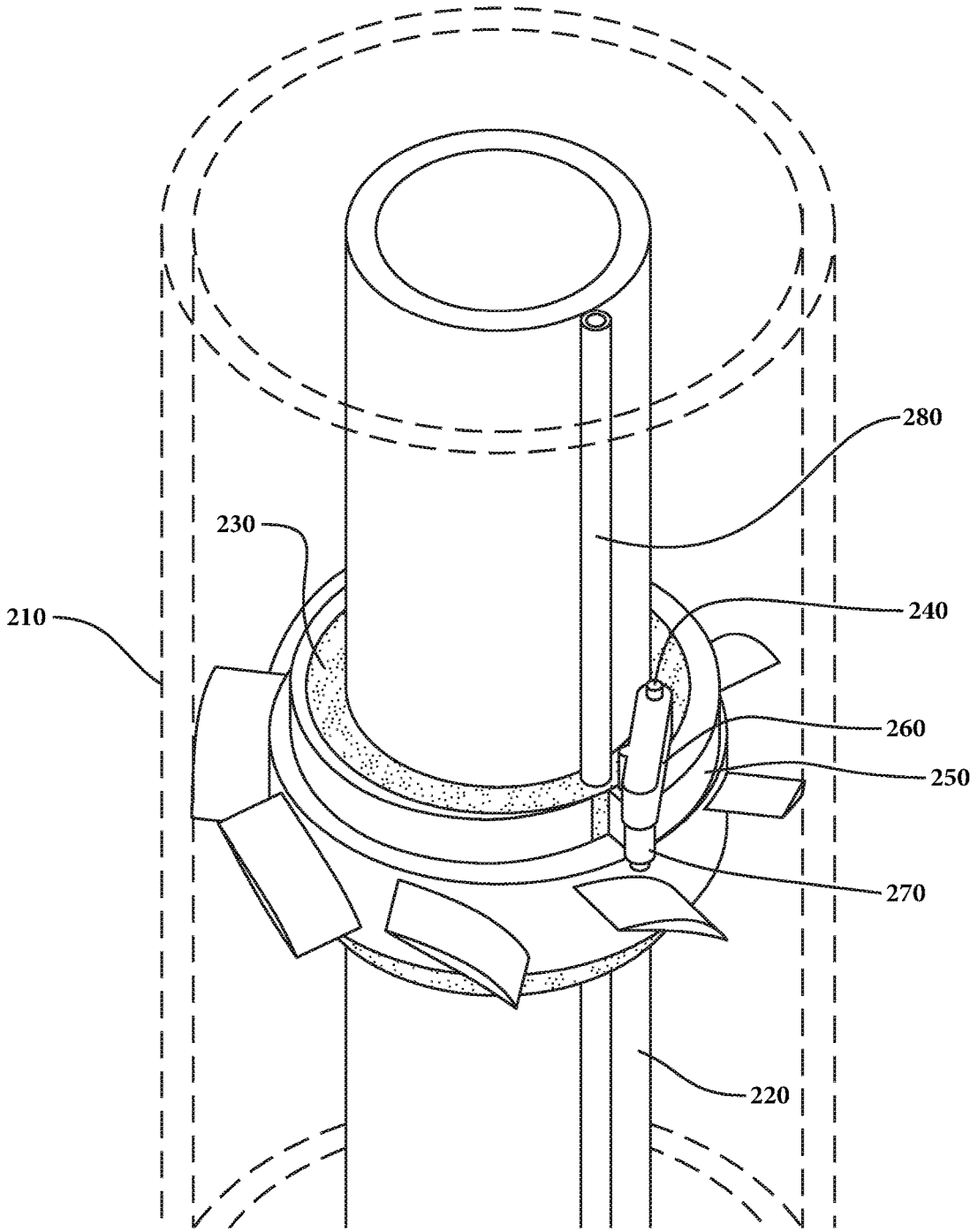
FIG. 2 illustrates a fiber optic flow measurement system using Distributed Acoustic Sensors within a tube and a low friction spinner with a flow hammer.

In an alternate embodiment, shown in FIG. 2, the fiber optic system is again a Distributed Acoustic Sensing (DAS) system where the sensing cable 280 includes an optical DAS fiber housed in a rugged tube suitable for use in a down-hole environment. The flow to signal conversion device is a low friction spinner 250 spinning around a stationary bearing 230 attached to a production string 220, which could be coiled tubing, that is deployed inside a well casing 210. A spring-loaded follower-hammer including a pin 240 mounted to bearing 230 to attach a hammer 260 with a roller 270 at an extended position. As the spinner spins due to the upward movement of oil the spring-loaded hammer follows along the spinner and strikes near or directly on the fiber on each revolution, creating an acoustic ping. The ping is detected by the DAS system interrogating the fiber optic cable, and the rate of pings is calibrated to the flow rate.

Figure 3:
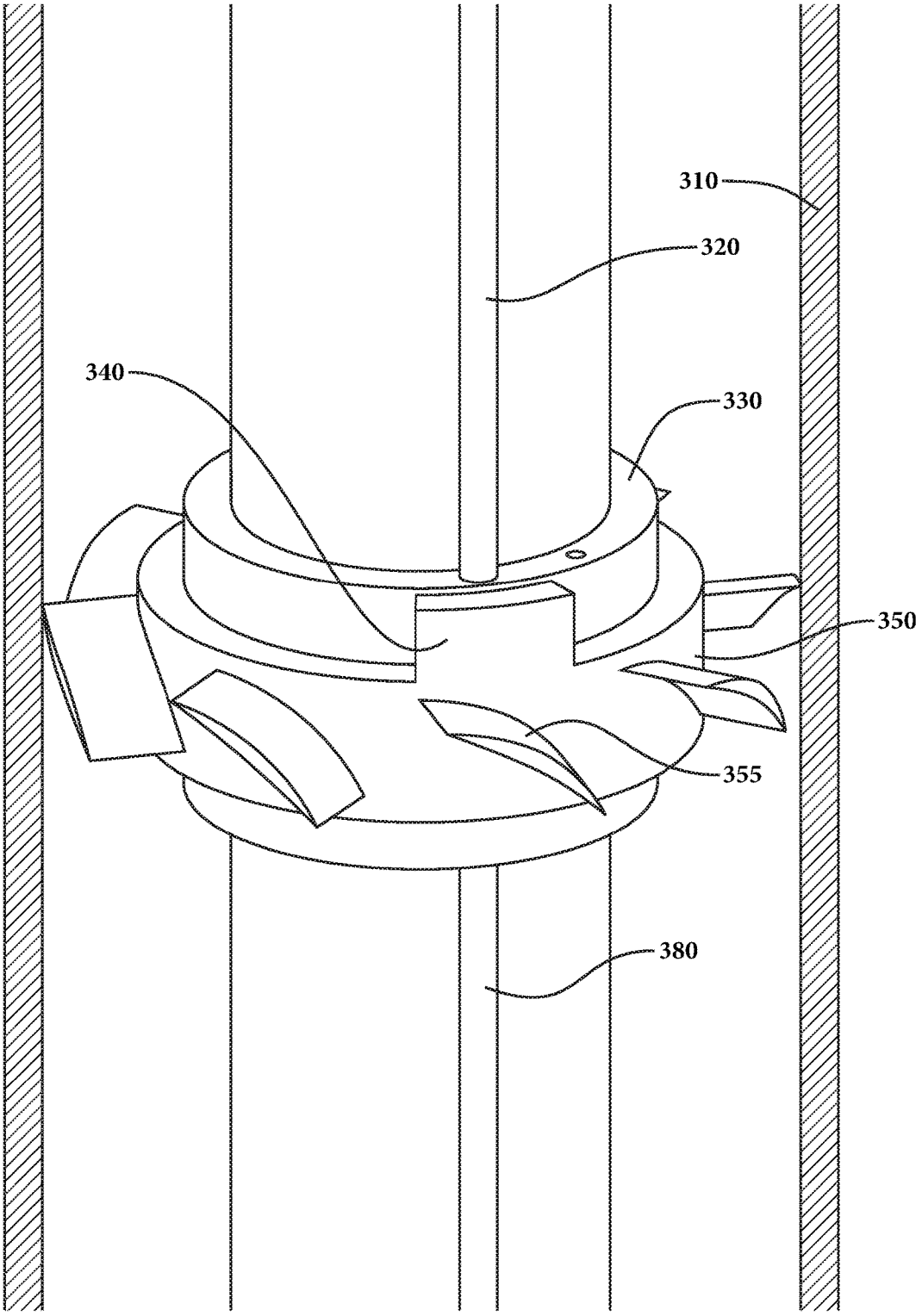
FIG. 3 illustrates a fiber optic flow measurement system using Fiber Bragg Gratings within a tube and a low friction spinner.

In another embodiment, shown in FIG. 3, the fiber optic sensing system is a Fiber Bragg Grating (FBG) based sensing system housed within a rugged tube 380 suitable for use in a down-hole environment and the flow to signal conversion device is again a low friction spinner that creates vibrations on the sensing cable and those vibrations are a function of the flow rate. In this embodiment the FBG based system is a mass spring system where acceleration due to vibration causes strain in the fiber and this strain causes a detectable wavelength shift. Spinner 350 includes a mass 340 that is off center from the spinner's axis and causes the cable to move/tilt as the mass rotates around the system. Both the amplitude and frequency of the wavelength shift can be used to derive the flow rate, and can be used to calibrate the flow rate of the oil. In this embodiment the FBG based sensing system can be Multiple FBG based sensors and can be either Time Division Multiplexed (TDM) or Wavelength Division Multiplexed (WDM).

Figure 4A:
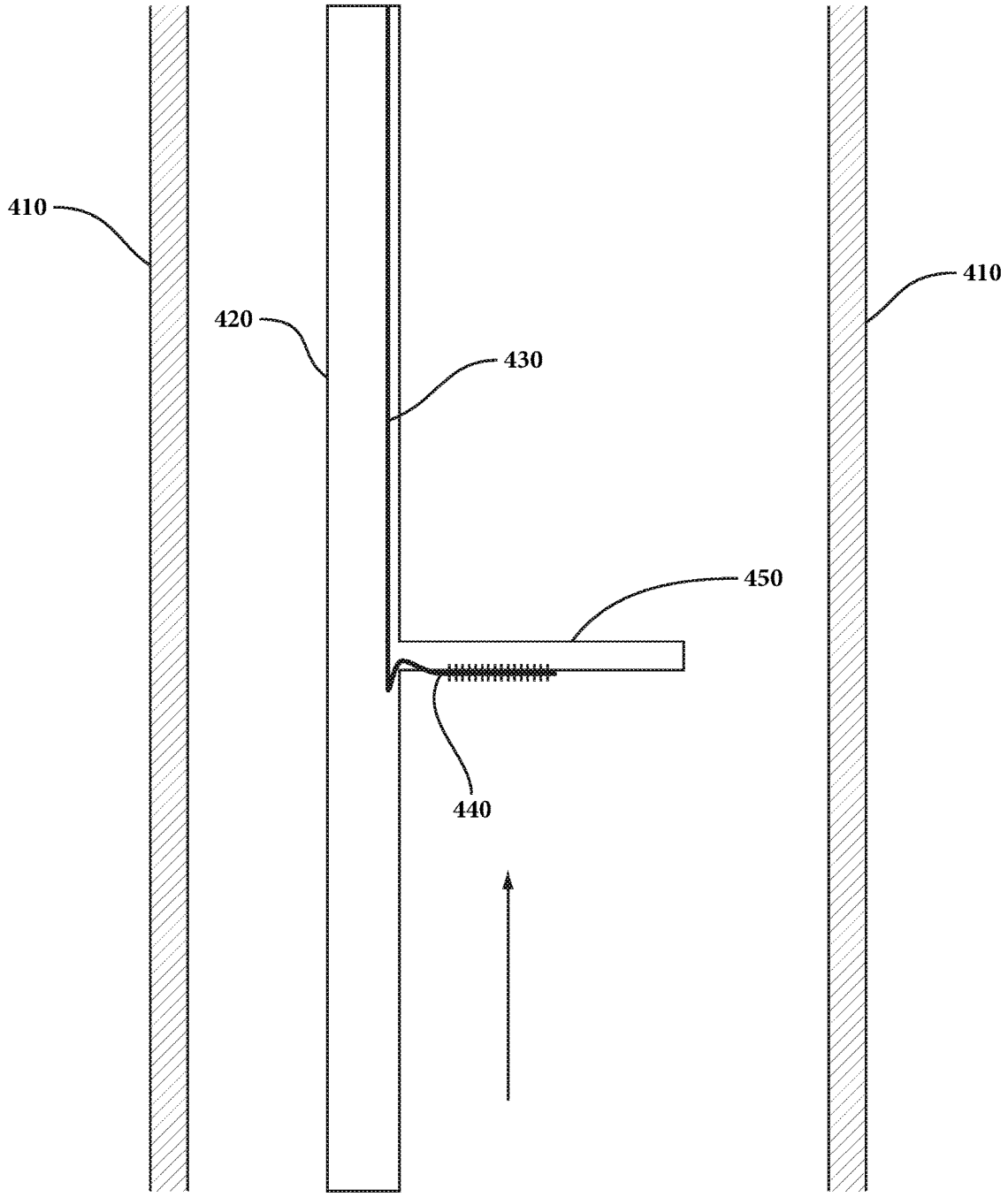
FIG. 4A illustrates a fiber optic flow measurement system using Fiber Bragg Gratings within a tube and a flexible arm.
Figure 4B:
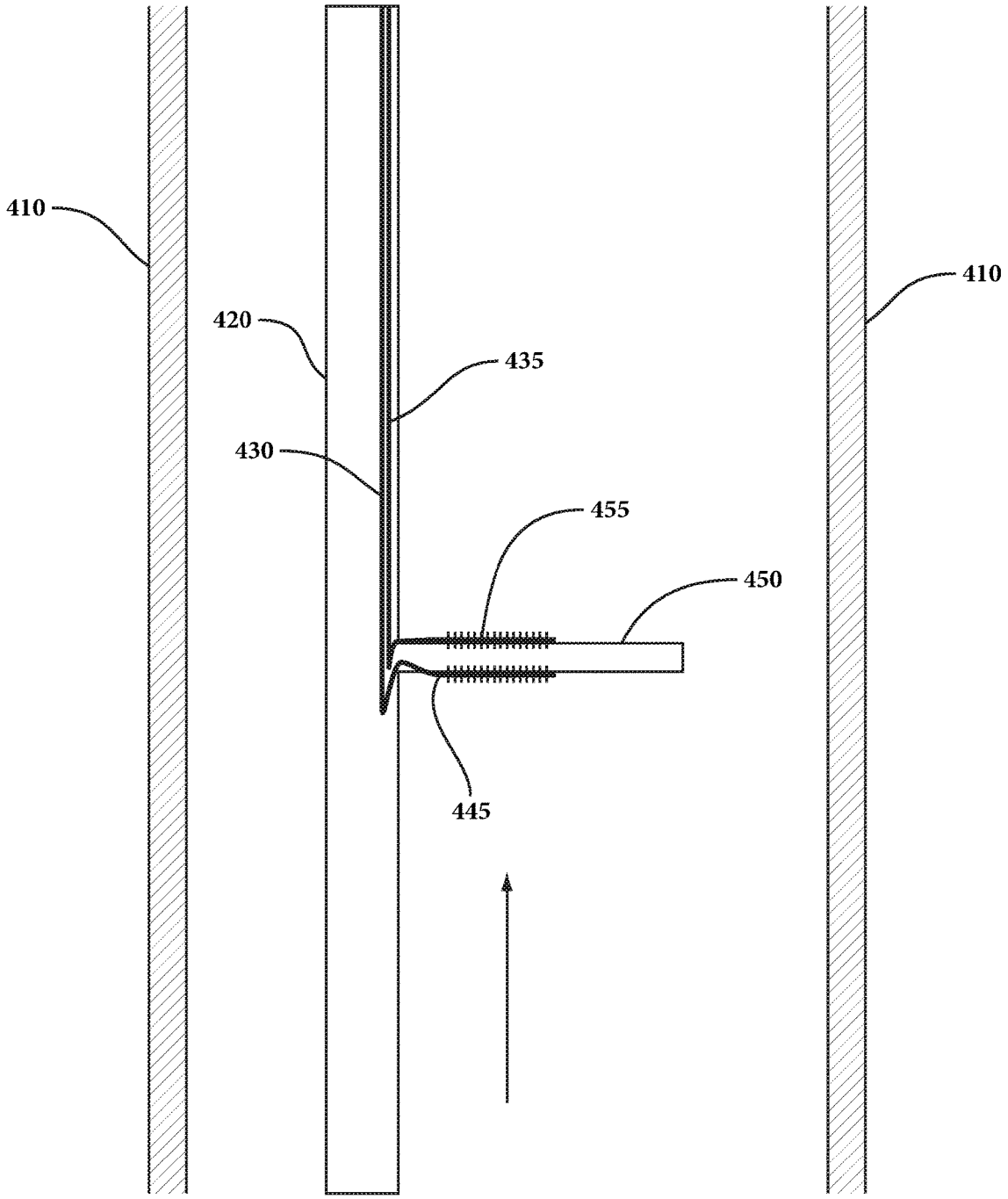
FIG. 4B illustrates a fiber optic flow measurement system using Fiber Bragg Gratings within a tube and a flexible arm.
Figure 4C:
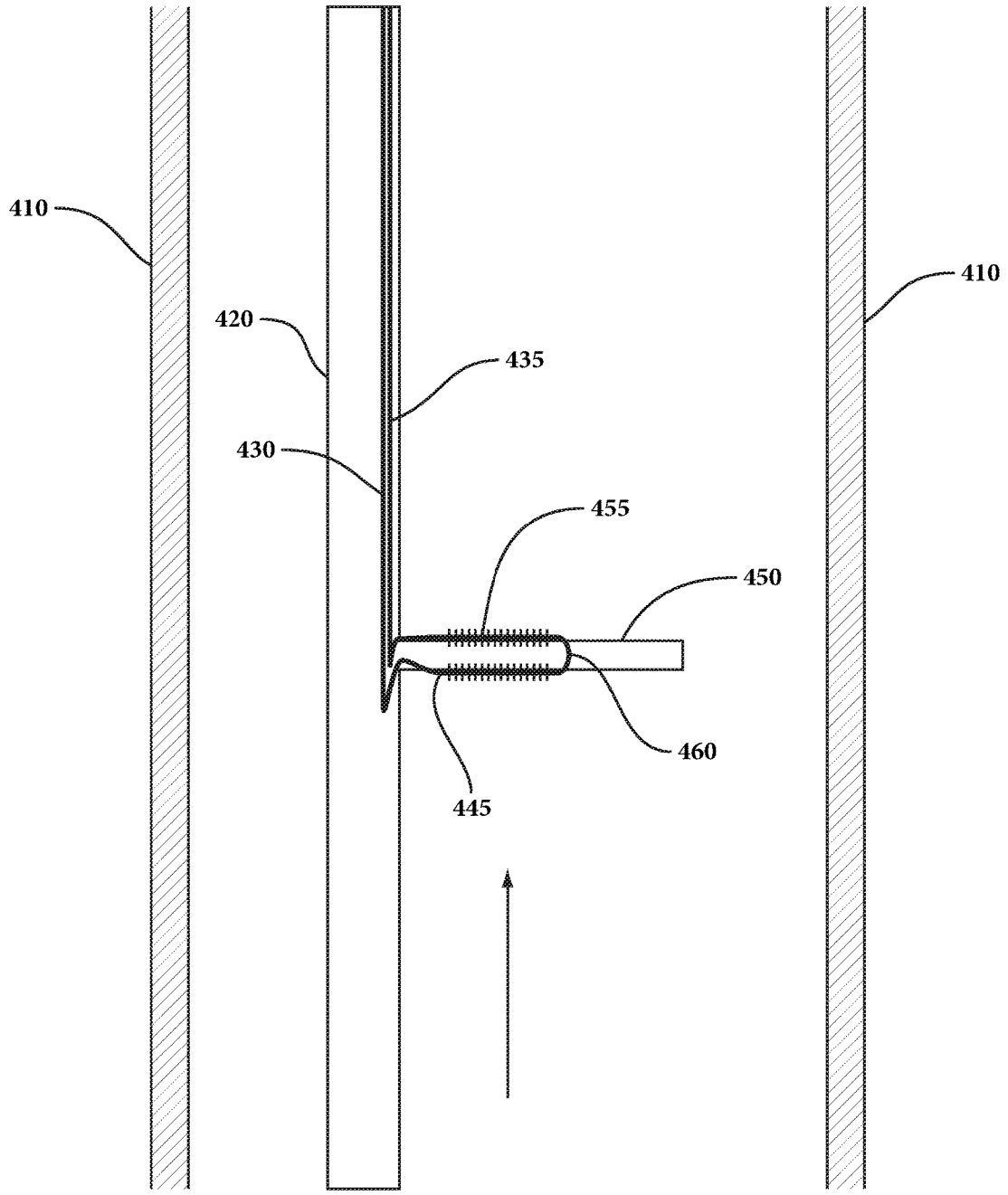
FIG. 4C illustrates a fiber optic flow measurement system using Fiber Bragg Gratings within a tube and a flexible arm.

In another embodiment, shown in FIGS. 4A, 4B, and 4C, the fiber optic sensing system is a Fiber Bragg Grating (FBG) based sensing system housed in a rugged tube 420 suitable for use in a down-hole environment. The tube might be a FIMT system and is shown in a well bore defined by well casing 410. The optical fiber 430 passes down the wellbore inside rugged tube 420. In these embodiments the flow to signal conversion device is a flexible arm 450 in which the movement of the arm is directly related to the flow rate. In all three of the drawings (4A, 4B, and 4C) the size of the tube and the flexible arm are not to scale. That is to say—the tube and flexible arm may be much smaller in relation to the size of the wellbore. The FBG strain sensor 440, connected to optical fiber 430, is deployed in the arm and will experience strain as the flexible arm bends and this strain causes a wavelength shift that can be detected and calibrated to the flow rate of the oil. In this embodiment the FBG based sensing system can be Multiple FBG based sensors and can be either Time Division Multiplexed (TDM) or Wavelength Division Multiplexed (WDM). FIGS. 4A, 4B, and 4C include three possible approaches, with 4A illustrating a single FBG strain sensor connected to a single optical fiber. FIG. 4B illustrates the use of two FBG sensors 445, 455 attached to two optical fibers 430, 435 in a push-pull configuration. Push-pull strain sensor configurations provide temperature independent bending moment measurements. FIG. 4C illustrates a second version of a push pull configuration in which the two FBG strain sensors are joined at the end.

Figure 5A:
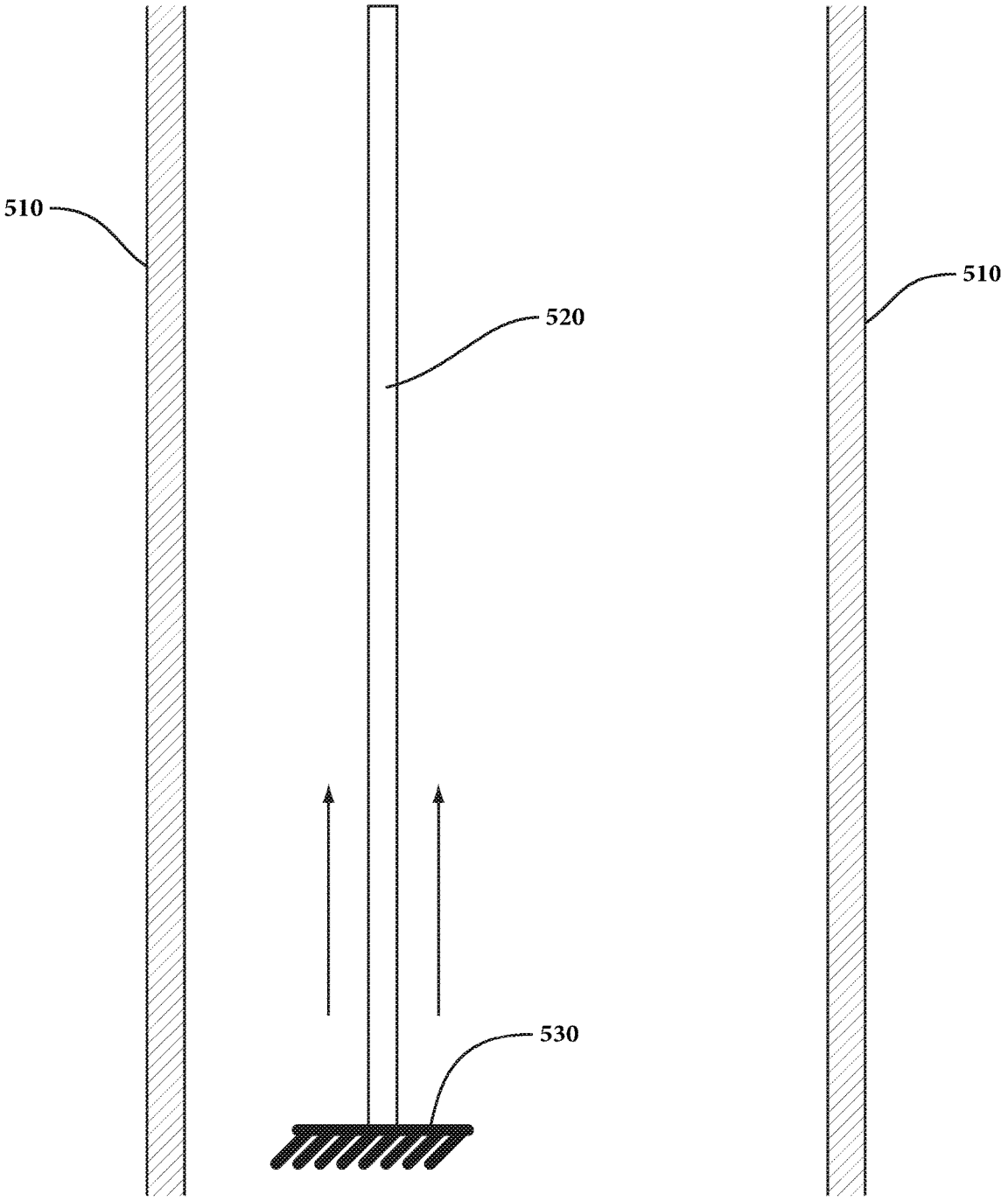
FIG. 5A illustrates a fiber optic flow measurement system using Distributed Acoustic Sensors within a tube using flow drag acting on the boundary of the tube.
Figure 5B:
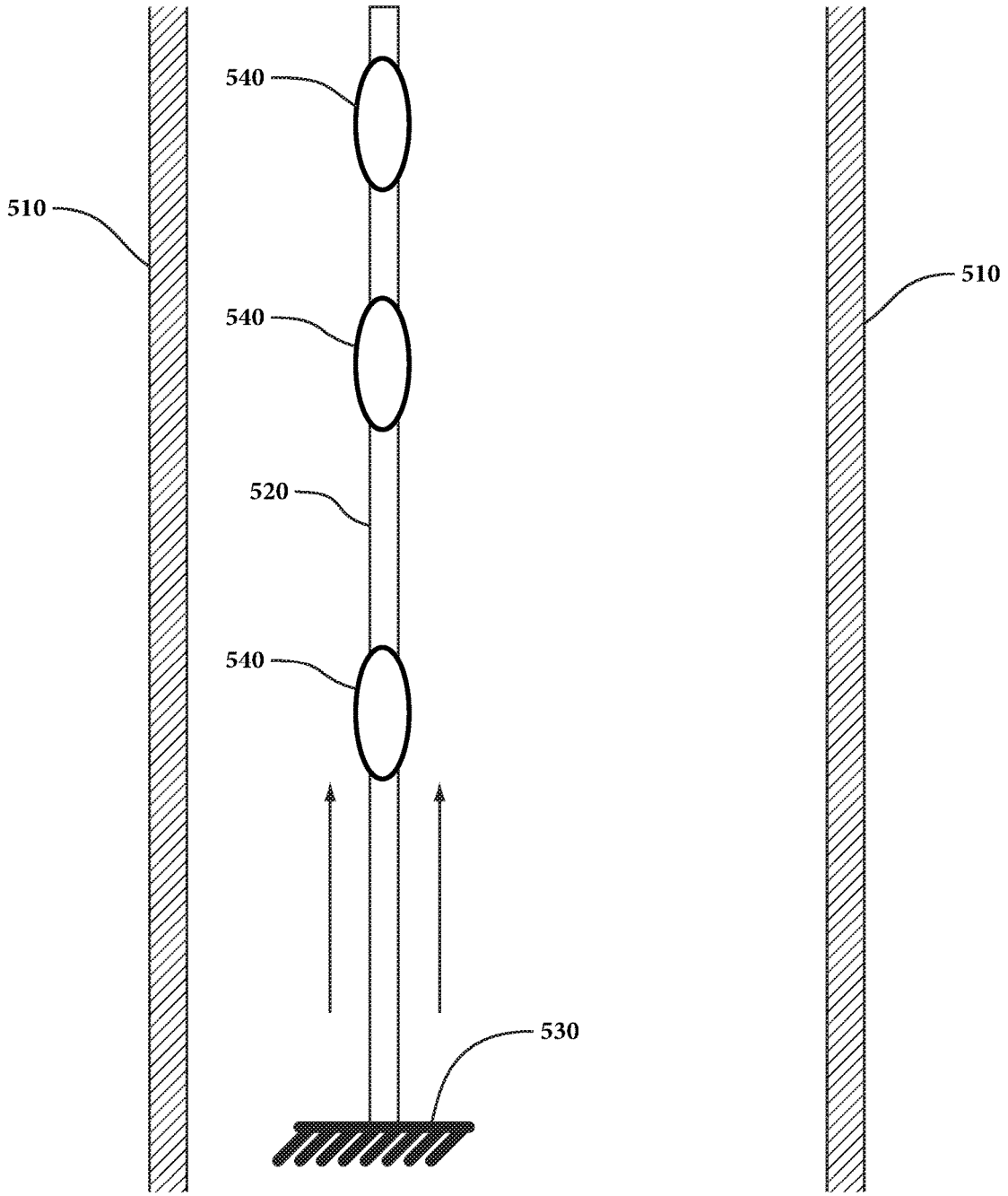
FIG. 5B illustrates a fiber optic flow measurement system using Distributed Acoustic Sensors within a tube using flow drag acting on symmetric bodies attached to the tube.

In another embodiment, shown in FIGS. 5A and 5B, the fiber optic sensing system is one suitable for strain sensing. This can be a Fiber Bragg Grating (FBG) based sensing system housed in a rugged tube 520 suitable for use in a down-hole environment deployed with a well bore defined by the well casing 510. It could also be a strain sensing fiber optic system using Brillouin scattering techniques, or other strain sensing systems. In these embodiments the flow to signal conversion device comprises a strain sensing cable 520 fixed at the bottom 530 of the well bore, as shown in FIG. 5A. An Increase in oil flow creates increased drag on the strain sensitive cable and this strain sensitive cable converts the strain to a wavelength shift in the FBG or the Brillouin based system located in the cable. These wavelength shifts can be calibrated against oil flow rate.

In a related manner, shown in FIG. 5B, symmetric bodies 540 attached to the tube 520 lead to increased drag. In this embodiment either or both of the bodies and the cable material can be chosen to make the cable neutrally buoyant. As in the embodiment of FIG. 5A, Increases in oil flow creates increased drag on the strain sensitive cable and attached body system and this combination converts the strain to a wavelength shift in the FBG or in the Brillouin scattering based system located in the cable. These wavelength shifts can be calibrated against oil flow rate.

In the embodiments of FIGS. 5A and 5B the FBG based sensing system can be Multiple spatially distributed FBG based sensors and can be either Time Division Multiplexed (TDM) or Wavelength Division Multiplexed (WDM).

Figure 6:
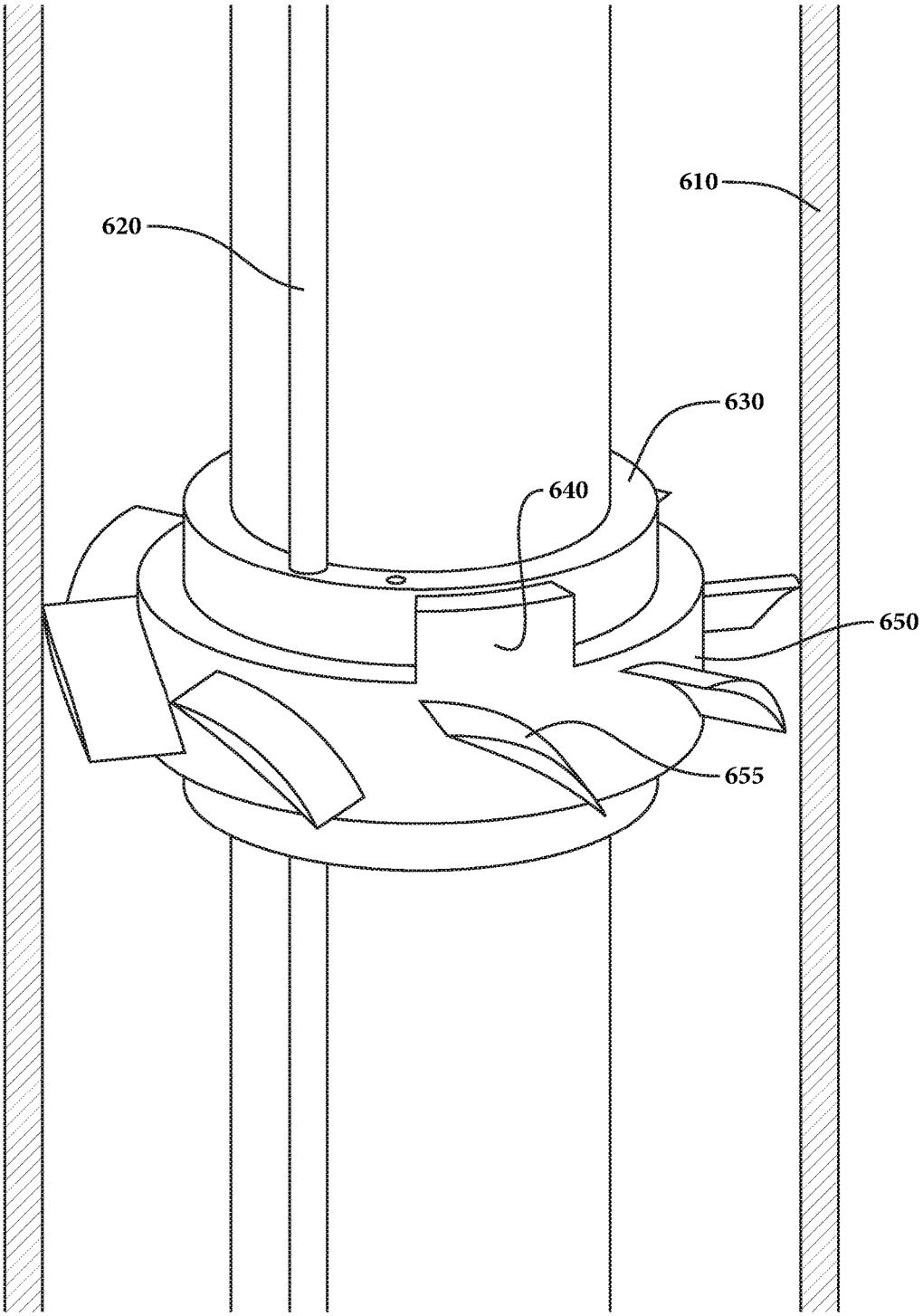
FIG. 6 illustrates a fiber optic flow measurement system using Micro Electro Mechanical sensors within a tube and a low friction spinner.

In another embodiment, shown in FIG. 6, the fiber optic sensing system is an interferometric system with Micro Electro Mechanical Systems (MEMS) based vibration sensors housed in a rugged tube 620 suitable for use in a down-hole environment and the flow to signal conversion device is again a low friction spinner 650 with associated flow blades 655 that capture some of the force of the flowing oil and therefore increase the spin rate. Spinner 650 includes a mass 640 that is off center from the spinner. This causes vibrations on the sensing cable and those vibrations are a function of the oil flow rate. The MEMS based vibration sensor then senses those vibrations, which are calibrated against the oil flow rate.

Figure 7:
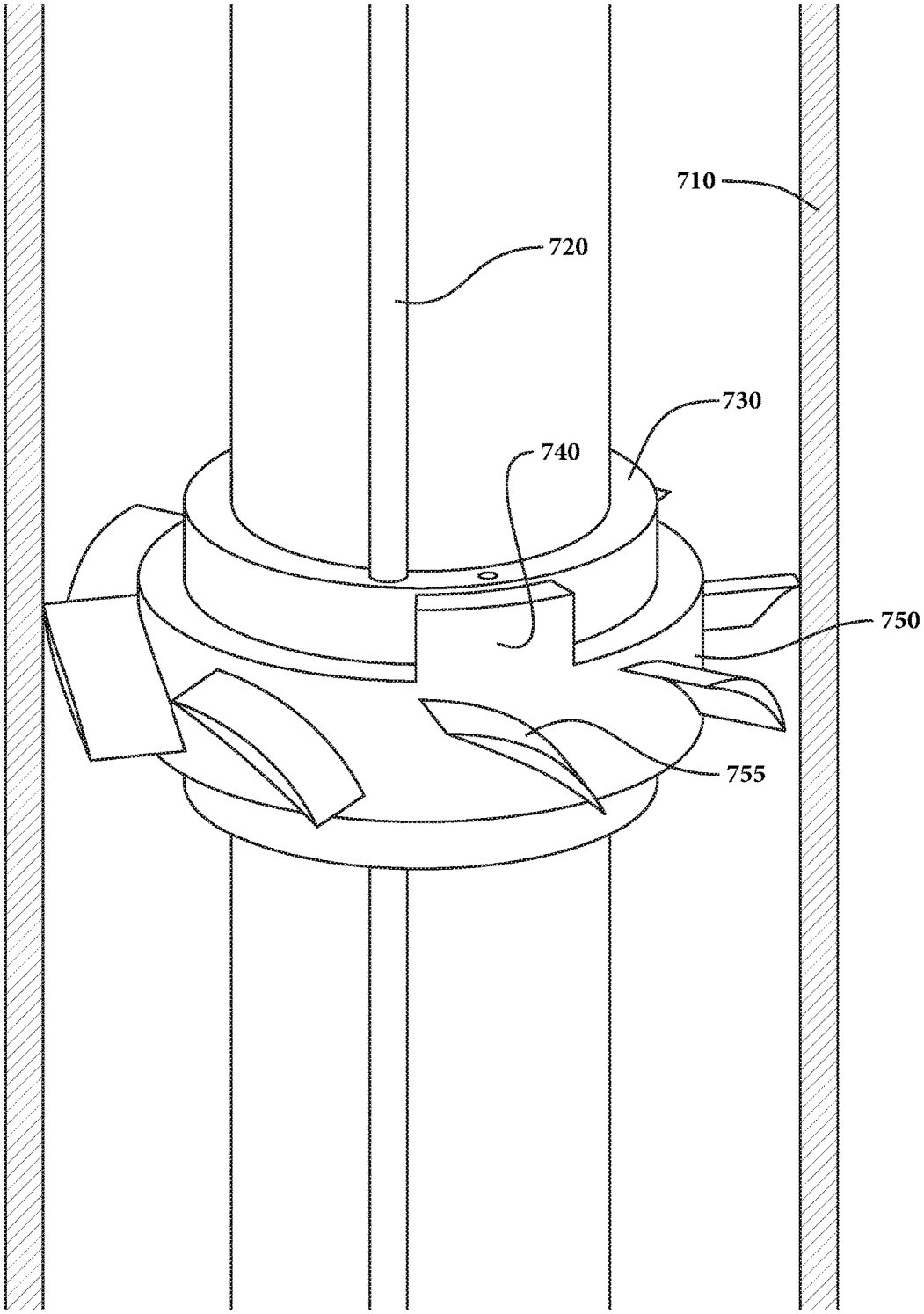
FIG. 7 illustrates a fiber optic flow measurement system using Electro Magnetic sensors within a tube and a low friction spinner.

In another embodiment, shown in FIG. 7, the fiber optic sensing system is an Electro Magnetic (EM) sensing system in which a magnetic field generates a signal on a sensing cable 780. Again spinner 750 has associated flow blades 755 that capture some of the force of the flowing oil and therefore increase the spin rate. There are several ways where the magnetic field detected by the sensor can be made to be proportional to the spinner rotation speed, and where the rotation speed of the spinner is related to the flow rate. In one approach the sensing cable is placed off center, as shown in FIG. 7, and the low friction spinner 750 placed largely in the center of the flow and equipped with a magnet placed in such a way that it rotates with the spinner. The magnet is shielded such that the signal intensity is strongest when the magnetic is in close proximity of the sensor and the signal intensity being the lowest when the magnet is rotated 180 degrees and away from the sensor. The resulting magnetic field exhibits an oscillation at the spinner's rotation frequency. The EM sensing system communicates this oscillation to the surface via the fiber optic cable.

In another approach the spinner can be a hollow core spinner such that the sensing cable and sensor can sit in the center of the spinner. The sensor is shielded such that the magnetic field from the magnet can only reach the sensor at one or several distinct positions, and the spinner rotation speed can be determined by the measured signals.

Of the embodiments disclosed herein the EM sensing system may be the best at higher flow-rates as vibrations and/or acoustic flow noise may introduce excessive noise in the DAS, FBG and MEMS based measurements.

Though the various systems discussed above have been described in terms of individual flow sensing locations, the contemplated systems may include multiple flow sensing locations to permit the detection of different flow rates at different points along the production flow path. Such multiple flow sensing locations may enable the system to measure changes in mass flow rates and/or volume flow rates that may be indicative of inflow locations, inflow rates, fluid loss zones, phase changes, and other information of particular value to the reservoir engineer.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

What is claimed is:

1. A strain based flow sensing fiber optic sensing cable for measurement of oil flow rates in production wells wherein:

the strain based flow sensing fiber optic sensing cable comprises a fiber optic sensing system housed within a tube suitable for a downhole environment and deployed within a well bore; and wherein the strain based flow sensing fiber optic sensing cable is a Fiber Bragg Grating (FBG) based sensing system housed within the tube suitable for a downhole environment the strain based flow sensing fiber optic sensing cable is fixed at the bottom of the well bore and the flow of oil creates a drag on the strain based flow sensing fiber optic sensing cable causing a FBG sensor of the FBG based sensing system to produce a wavelength shift based on the drag, wherein the wavelength shift is calibrated against the oil flow rates in the production wells.

2. The strain based flow sensing fiber optic sensing cable for measurement of oil flow rates in production wells of claim 1 wherein one or more bodies are attached to the tube of the strain based flow sensing fiber optic sensing cable and the flow creates a drag on the bodies attached to the tube of the strain based flow sensing fiber optic sensing cable, which is sensed by the FBG based sensing system housed within the strain based flow sensing fiber optic sensing cable.

3. The strain based flow sensing fiber optic sensing cable of claim 2, wherein the one or more bodies are neutrally buoyant in the oil of the wellbore.

4. A strain based flow sensing fiber optic sensing cable for measurement of oil flow rates in production wells wherein:

the strain based flow sensing fiber optic sensing cable comprises multiple combinations of a fiber optic sensing cable system housed within a tube suitable for a downhole environment and deployed in the oil flow;

wherein the multiple combinations of the fiber optic sensing cable system include multiple flow sensing locations to permit the detection of different flow rates at different points along the production flow path; and wherein the multiple combinations of the fiber optic sensing cable system comprise a Fiber Bragg Grating (FBG) based sensing system within the strain based flow sensing fiber optic sensing cable and the strain based flow sensing fiber optic sensing cable is fixed at the bottom of a well bore and the flow of oil creates a drag on the strain based flow sensing fiber optic sensing cable causing a FBG sensor of the FBG based sensing system to produce a wavelength shift based on the drag, wherein the wavelength shift is calibrated against the oil flow rates in the production wells.

5. The strain based flow sensing fiber optic sensing cable for measurement of oil flow rates in production wells of claim 4 wherein one or more bodies are attached to the tube of the strain based flow sensing fiber optic sensing cable and the flow creates a drag on the bodies attached to the tube of the strain based flow sensing fiber optic sensing cable, which is sensed by the FBG based sensing system housed within the strain based flow sensing fiber optic sensing cable.

6. The strain based flow sensing fiber optic sensing cable of claim 5, wherein the one or more bodies are neutrally buoyant in the oil of the wellbore.

7. The strain based flow sensing fiber optic sensing cable for measurement of oil flow rates in production wells of claim 5 wherein the FBG based sensing system can be multiple spatially distributed FBG based sensors and can be either Time Division Multiplexed (TDM) or Wavelength Division Multiplexed (WDM).

8. The strain based flow sensing fiber optic sensing cable for measurement of oil flow rates in production wells of claim 4 wherein the FBG based sensing system can be multiple spatially distributed FBG based sensors and can be either Time Division Multiplexed (TDM) or Wavelength Division Multiplexed (WDM).

9. A method for measuring oil flow rates in production wells using a strain based flow sensing fiber optic cable, the method comprising:

deploying the strain based flow sensing fiber optic cable into a production well having a perforated production interval to be monitored; and monitoring the oil flow rate from that production interval, wherein said strain based flow sensing fiber optic cable comprises: a fiber optic sensing system housed within a tube suitable for a downhole environment; and wherein the fiber optic sensing system is a Fiber Bragg Grating (FBG) based sensing system housed within the tube suitable for a downhole environment and the strain based flow sensing fiber optic cable is fixed at the bottom of a well bore and the flow of oil creates a drag on the strain based flow sensing fiber optic cable causing a FBG sensor of the FBG based sensing system to produce a wavelength shift based on the drag, wherein the wavelength shift is calibrated against the oil flow rates in the production wells.

10. The method for measuring oil flow rates in production wells using a strain based flow sensing fiber optic cable of claim 9 wherein one or more bodies are attached to the tube of the strain based flow sensing fiber optic cable and the flow creates a drag on the bodies attached to the tube of the strain based flow sensing fiber optic cable which is sensed by the FBG based sensing system housed within the strain based flow sensing fiber optic cable.

11. The method of claim 10, wherein the one or more bodies are neutrally buoyant in the oil of the wellbore.

12. The method for measuring oil flow rates in production wells using a strain based flow sensing fiber optic cable of claim 10 wherein the FBG based sensing system can be multiple spatially distributed FBG based sensors and can be either Time Division Multiplexed (TDM) or Wavelength Division Multiplexed (WDM).

13. The method for measuring oil flow rates in production wells using a strain based flow sensing fiber optic cable of claim 9 wherein the FBG based sensing system can be multiple spatially distributed FBG based sensors and can be either Time Division Multiplexed (TDM) or Wavelength Division Multiplexed (WDM).

* * * * *